United States Patent [19]

Ezquerro

[11] 4,357,198

[45] Nov. 2, 1982

[54] TAPE APPLICATOR

[76] Inventor: Isaac E. Ezquerro, P.O. Box 736, Brawley, Calif. 92227

[21] Appl. No.: 293,071

[22] Filed: Aug. 17, 1981

[51] Int. Cl.[3] ..... B32B 31/08; B32B 31/18

[52] U.S. Cl. ..... 156/391; 156/527; 156/543; 156/577; 156/579

[58] Field of Search ..... 156/391, 523, 526, 527, 156/543, 554, 574, 577, 579

[56] References Cited

U.S. PATENT DOCUMENTS

| | | | |
|---|---|---|---|
| 1,739,296 | 12/1929 | Du Pont | 156/577 |
| 2,809,761 | 10/1957 | Delbert | 156/527 |
| 2,953,274 | 9/1960 | Bertschinger | 156/577 |
| 2,999,609 | 9/1961 | Thompson | 156/527 |
| 3,150,027 | 9/1964 | Moyer | 156/523 |
| 4,093,494 | 6/1978 | Boettcher | 156/577 |

*Primary Examiner*—Michael G. Wityshyn

*Attorney, Agent, or Firm*—Ralph S. Branscomb

[57] ABSTRACT

A tape applicator for masking purposes utilizes a pair of frames, one of which can be used singly, which when mounted together enable the application of two parallel rows of tape which are evenly and effectively pressed against the surface to be masked by a pair of specialized applicator heads. The spacing of the two lines of tape is adjustable, and the machine can be modified by the switching of several parts to handle quarter inch or eighth inch wide tape.

18 Claims, 16 Drawing Figures

TAPE APPLICATOR

BACKGROUND OF THE INVENTION

Although useful in any application in which the painting of uniform width stripes is desired, the invention was created principally for use by sign painters, auto trim painters, and other painters involved in the commercial arts.

It is difficult to paint stripes of uniform width when making signs, such as along the borders of sign panels, or within the panel to underline or box in copy. Some painting tasks involve a considerable amount of line work on a single panel, such as plot plan layouts and industrial diagrams.

For years the industry has used a striping tool which delivers paint from a paint reservoir through a paint application wheel. This device has the capability of making stripes up to one quarter inch in width. However, although the striper is quite useful, it has several disadvantages. First, the width of the stripe is limited to a quarter of an inch. Also, the striper has to be cleaned after every use, which is a messy job. Also, when laying stripes over one another, for example when making a grid, if a first stripe is not dry before laying a second stripe over it a mess can result on the surface being painted. Lastly, the striper is not reliable except on a horizontal surface.

Although devices have been conceived which lay one or two tape stripes on a surface, absence of implementation of these units and their appearance in commerce indicates that they are undesireably complex and expensive, or perhaps are not reliable. There is a need, therefore, for a dual tape applicator capable of applying a pair of parallel rows of tape which is reliable, simple and inexpensive to produce. The instant invention fulfills the above stated need by providing a tape applicator capable of applying two parallel stripes of tape, and also capable of use singly, by the removal of one of the tape roll frames. Of the two frames which are used to respectively mount tape roll drums, one of them has a handle which is used when making either one or two tape rows. The two frames are spaced apart adjustably by a threaded shaft passing through one frame and engageing the other and having an adjustment knob on one end.

Each of the frames defines a specialized applicator head having a leading applicator tongue which is a resilient element effective in pressing the tape against the surface to which it is to be applied. Behind the tongue is an arcuate strip of foam, and trailing the foam is a knife blade adjacent a pair of embracing arms encircling the tape path. The effect of the arcuate applicator heads permits the machine to be rolled over the heads to engage the blades.

An adjustable shoulder following guide is included which may be used in either the single or double tape mode. A magnetic shoulder-defining strip is also provided for use on vehicle bodies and other ferromagnetic surfaces to guide the machine, and another type of band, defining a shoulder and sequential central voids, can be used with masking tape on a non-magnetic surface to provide a reference for the machines's guide.

DETAILED DESCRIPTION OF THE PREFERRED EMBODIMENT

Figure 1:
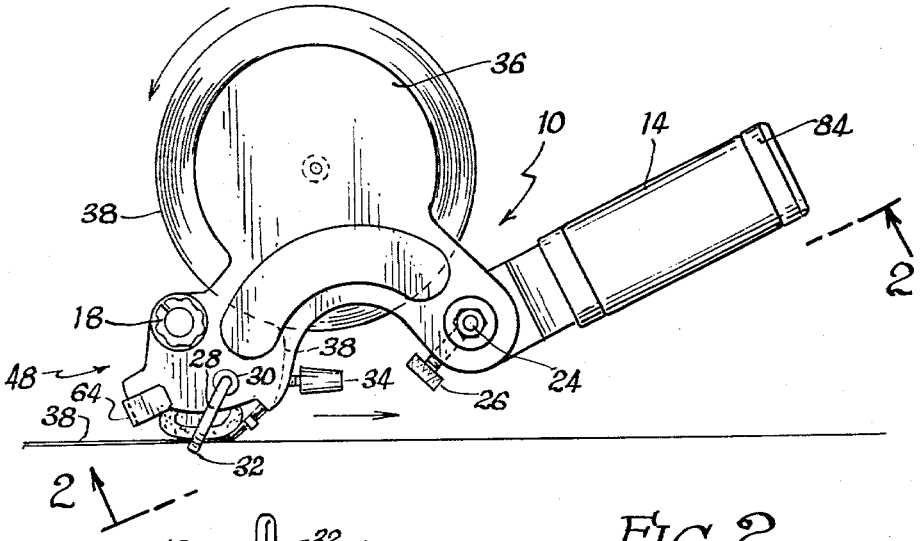
FIG. 1 is a side elevation view of the machine in use.
Figure 2:
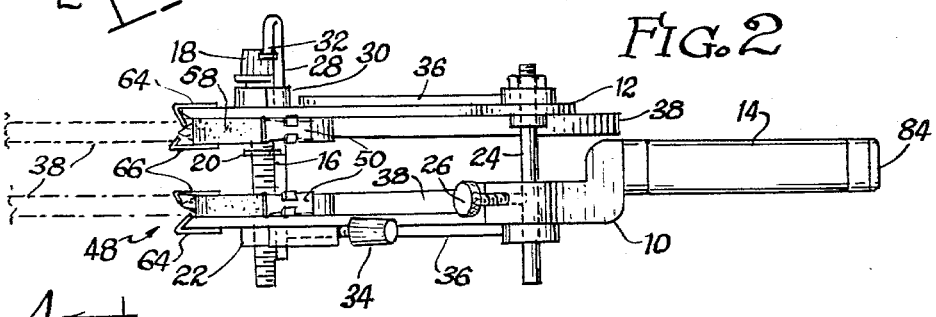
FIG. 2 is an illustration taken along line 2—2 of FIG. 1.
Figure 3:
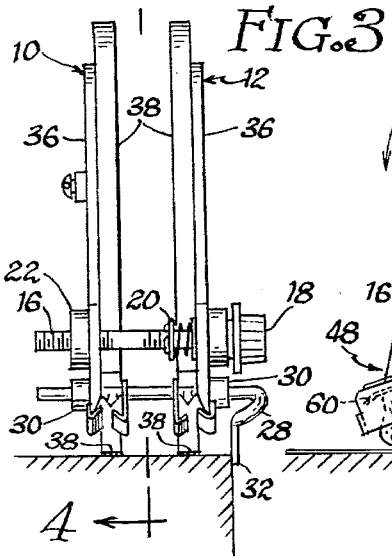
FIG. 3 is a front elevation view of the machine.

The machine utilizes two frames 10 and 12 each having tape roll holding means and an applicator identical to that of the other. The first frame, however, includes a handle 14 which is offset centrally as best shown in FIG. 2 so that pressures are balanced when the two frames are used together. The frames are adjustably spaced and maintained in spaced relation by a threaded shaft 16 having an adjustment knob 18 on one end, with the portion passing through the frame 12 being freely rotatable, and retained by a spring-loaded clip 20 to increase the stability of frame 12. The other end of the shaft engages a threaded boss 22 so that rotation of the knob varies frame spacing. A stabilizing bar 24 is bolted to frame 12 and slides through frame 10 as can be seen in FIG. 2. Set screw 26 may be used to fix the spacing of the frames. A guide rod 28 also passes through reinforced areas 30 in both frames and is bent into a follower tip 32 so that it can be used along a shoulder or an edge, such as the edge of a sign panel, to enable the machine to be drawn along an established reference line. Set screw 34 in frame 10 fixes the spacing of the guide member so that the guide may be used on either side of the machine in its dual tape mode or in either side of the frame 10 with the second frame 12 removed.

Each of the frames is generally planar and defines an upper circular side panel 36, each of which mounts a roll of thin masking tape 38 on a thin drum 40. The drums 40 have a discontinuity which is filled by a spring-loaded drum segment 42, which in the illustrated embodiment is the segment itself, made of a springy plastic, rigidly fixed at one end in a mounting slot 44. Radial detent tabs 46 are mounted on small spacer blocks adhered to the planar portion of the respective frame members to engage the tape roll 38. The spring loaded segment 42 is depressed by the tape roll itself when removing an old roll or putting on a new roll, so that the positive action of the tabs can be achieved and still permit engagment of the tape roll on the drum.

The tape feeds off of the rolls in a prescribed path that passes the individual strands of tape across applicator head 48. The applicator heads are identical and each one is formed by moulding and by bonding a series of parts to the planar frame structure of the frames 10 and 12 respectively. Overall arrangement of the applicator head structure can be seen in FIG. 6. The first element encountered by the tape in the applicator head is applicator tongue 50 which is a resilient element protruding from a small mounting block 52. The applicator tongue can be slipped out of the mounting block and replaced with a different sized applicator for use with different tape widths.

Figure 5:
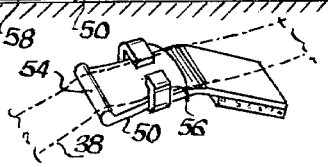
FIG. 5 is an isometric of the applicator tongue with the tape illustrated in phantom.

The structure of the applicator tongue includes a wide lip 54, which is wider than the tape itself, and retaining arms 56, best seen in FIG. 5, which embrace the prescribed path of the tape but have a gap between their ends to permit lateral insertion of the tape.

Although the springy applicator tongue applies most of the pressure against the tape as it is drawn across a surface, it is backed by a resilient foam arc 58 which both supports the rear of the applicator tongue directly and also applies a continuing pressure on the tape downstream of the applicator tongue as the head is drawn across the surface.

Figure 8:
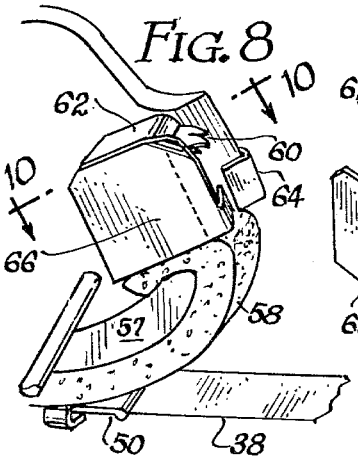
FIG. 8 is an isometric view of the applicator head.
Figure 9:
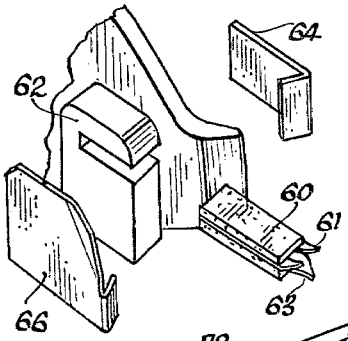
FIG. 9 illustrates the removable cutter and its mount in exploded perspective.
Figure 10:
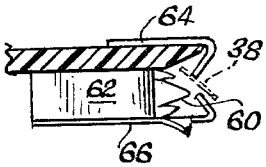
FIG. 10 is a section through line 10—10 of FIG. 8.
Figure 11:
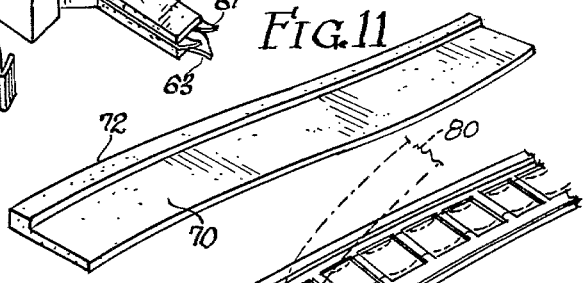
FIG. 11 illustrates a magnetic shoulder defining band.

The final element of the applicator head, downstream of the foam arc, is a cutting knife 60 mounted in a block 62 best shown in FIGS. 8 through 10. The knife itself is removable from the block for replacement as shown in FIG. 9 and is designed to effectively cut off either ¼ or ⅛ inch tape. This is achieved by making a V-shaped cutting blade and then making two spaced longitudinal slits approximately 150 inch apart. The two outer bladelets 61 are then bent in the opposite direction of the center bladelet 63, and an effective cutting blade is provided for both 150 inch and ¼ inch tape, which is harder to do than one might think. Also, although the scale of the drawings is too small to show it, the blade should be serrated. Just upstream of the knife are a pair of retaining arms 64 and 66 bonded to the opposite sides of the frame and mounting block as shown in FIG. 9.

Figure 6:
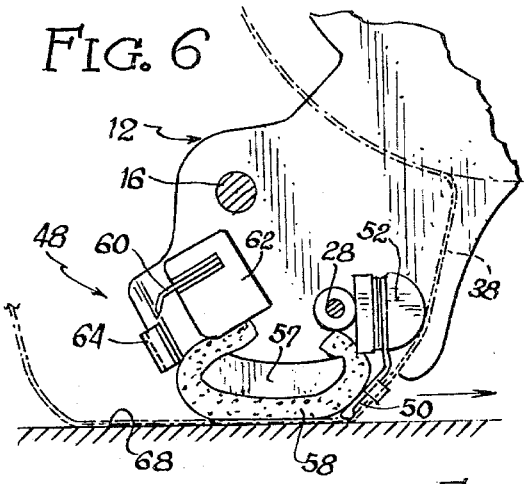
FIG. 6 is an enlarged view of the applicator head of FIG. 4.
Figure 7:
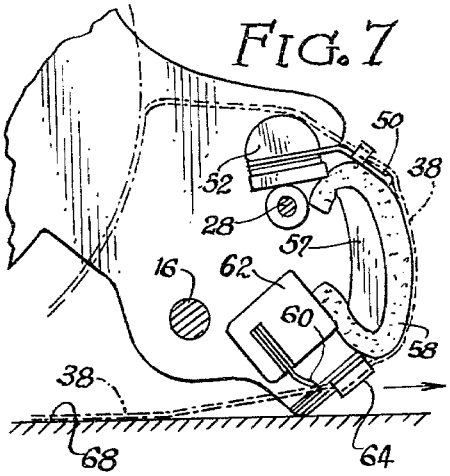
FIG. 7 illustrates the applicator head of FIG. 6 utilized in its tape cutting mode.
Figure 16:
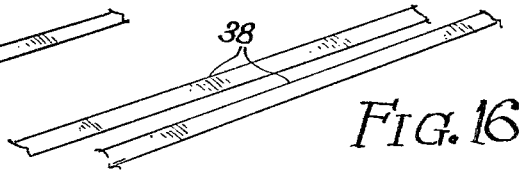
FIG. 16 illustrates the double tape row.

Operation of the cutter is illustrated in FIGS. 6 and 7. As the applicator head is drawn across a surface to the right as shown in FIG. 6, the parts function as detailed above to firmly press the tape against the underlying surface 68. When the ribbons of tape have been laid out, as indicated in FIG. 16 for the dual tape, the machine is counter rotated back toward the start of the tape line as shown in FIG. 7 and, while preventing the tape rolls from rotating, the machine is pressed to the right, cutting the tape with the knives 60.

Figure 12:
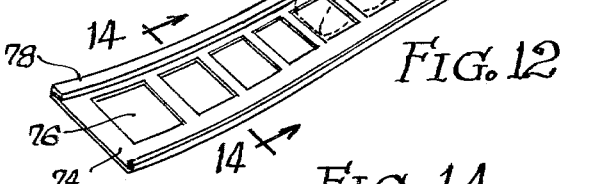
FIG. 12 illustrates a ladder type shoulder defining band.
Figure 13:
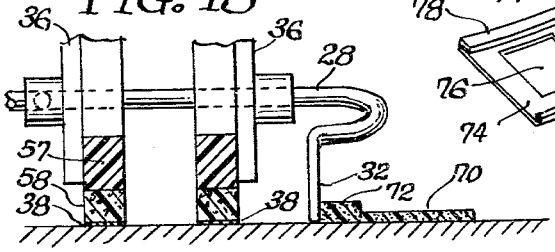
FIG. 13 is a lateral section through the applicator heads showing the guide in use.
Figure 14:
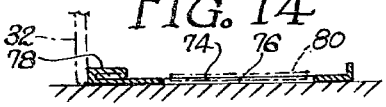
FIG. 14 illustrates the tape of FIG. 12 in use.
Figure 15:
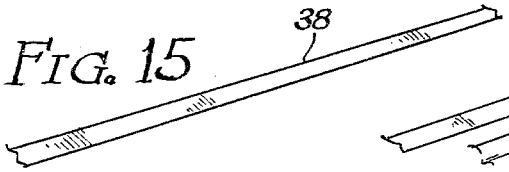
FIG. 15 illustrates a single line of tape applied by one frame only.

As indicated above, the machine can be used for a single tape line by removing the frame 12 to produce a line as shown in FIG. 15. In either the double or single tape mode, in the event there is no straight reference line available to engage the guide 28, a magnetic strip 70 having a shoulder 72 may be used if the painting is being done on a ferromagnetic surface such as a vehicle body. If the painting is not being done on a ferromagnetic surface, an open band 74 having central voids 76 and a shoulder 78 can be used in conjunction with a strip of masking tape 80 as shown in FIGS. 12 and 14.

One further feature of the invention is its handle 14, which defines a hollow void 82 with an end cap 84. This provides a storage space for spare parts, such as additional knives and applicator tongues, which may be of different sizes to accomodate different tape widths. However, although as stated above the machine can be changed from one tape size to another, in use by a professional ordinarily two applicators would be available, one loaded with eight inch tape and the other with quarter inch tape.

Figure 4:
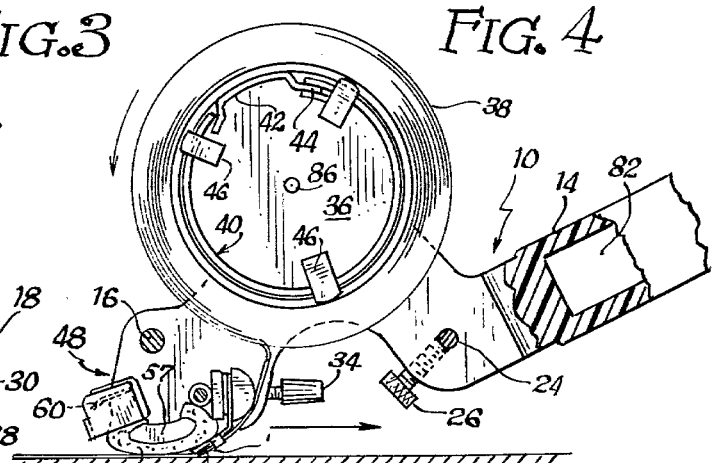
FIG. 4 is a section taken along line 4—4 of FIG. 3.

A small projection 86, visible in FIG. 4, extends from the frame 10 and butts up against a small boss on the opposite frame to prevent the two tape rolls from binding when they are brought quite close together. There is no limit to the narrowness of the space that can be made between the two lines of tape.

As thus illustrated, described and claimed, a versatile, inexpensive and easy to use tape applicator is provided with both dual and single tape application mode, with cooperating guide means to enable straight lines to be painted on virtually any surface.

While I have described the preferred embodiment of the invention, other embodiments may be devised and different uses may be achieved without departing from the spirit and scope of the appended claims.

What is claimed is:

1. A dual tape masking machine comprising:

(a) a first frame for mounting a first roll of tape and having a handle;

(b) an applicator head on said frame for pressing said tape against a surface as it feeds from said roll, said head and frame defining a prescribed path for dispensing tape;

(c) a second frame for mounting a second roll of tape and having an applicator head thereon, said second head and second frame defining a prescribed tape dispensing path;

(d) means releasably mounting said frames substantially parallel with said applicators side by side to permit concomitant application of tape from each of said frames, or alternative use of said first frame independently of said second frame to apply a single line of tape.

2. Structure according to claim 1 wherein said mounting means is adjustable to permit varying the spacing between said frames when used concomitantly.

3. Structure according to claim 2 wherein said mounting means comprises a threaded shaft passing through both of said frames and being rotationally mounted in one of said frames and threadedly engaged through the other of said frames, and including a stabilizing rod passing through both of said frames transversely.

4. Structure according to claim 1 wherein said applicator heads each include a resilient applicator tongue mounted to the respective frame behind the respective prescribed path to press tape against a surface.

5. Structure according to claim 4 wherein said applicator tongues are removably mounted on the respective frames.

6. Structure according to claim 5 wherein each of said tongues includes a pair of folded arms embracing the respective prescribed path and a lip transverse of and wider than the respective prescribed path defined by the respective tongue.

7. Structure according to claim 4 wherein each of said applicator heads includes a resilient pad defining an arcuate portion of the paths downstream of the respective tongues.

8. Structure according to claim 7 and including a knife edge downstream of said pads.

9. Structure according to claim 8 and including a pair of arms for each knife embracing the respective prescribed path upstream of the knife.

10. Structure according to claim 1 and including a shoulder following guide extending from at least one of said frames to permit following a shoulder with said machine.

11. Structure according to claim 10 wherein said guide is adjustably spaced from the frame to which it mounts and is adapted to mount selectably to either frame.

12. Structure according to claim 11 wherein said guide includes a rod passing through both of said frames when same are mounted together and including a set screw in said first frame to fix said rod at a selected guide spacing.

13. Structure according to claim 10 and including a flexible band defining a shoulder to permit use of said guide on ferromagnetic surfaces such as vehicle bodies.

14. Structure according to claim 10 and including a flexible band defining a shoulder and having a series of internal voids to permit use of said band to define a shoulder for said guide by application of tape on said band spanning said voids to adhere to an underlying surface.

15. Structure according to claim 1 wherein each of said frames includes a spool for mounting said roll of tape and said spool includes radial retaining fingers and a spring-loaded section to permit said roll to engage over said fingers.

16. Structure according to claim 1 wherein said handle is hollow and includes an end plug.

17. Structure according to claim 1 wherein at least one of said frames has a projection centrally of a tape roll engaged thereby and extended towards the other of said frames and is dimensioned to conflict with the other of said frames prior to the point of mutual contact of tape on said frames as same are drawn together.

18. Structure according to claim 1 wherein each one of said applicator heads includes a tape cutting knife with a V-cut edge with two centered, spaced longitudinal slits defining two outer bladelets projecting at a different angle from the inner bladelet whereby tapes of two different widths can effectively be cut.

* * * * *